US007862911B2

(12) United States Patent
Mizuno et al.

(10) Patent No.: US 7,862,911 B2
(45) Date of Patent: Jan. 4, 2011

(54) THERMAL SPRAY COATING AND THERMAL SPRAY POWDER

(75) Inventors: Hiroaki Mizuno, Kakamigahara (JP); Junya Kitamura, Kakamigahara (JP)

(73) Assignee: Fujimi Incorporated, Kiyosu-shi, Aichi (JP)

( * ) Notice: Subject to any disclaimer, the term of this patent is extended or adjusted under 35 U.S.C. 154(b) by 730 days.

(21) Appl. No.: 11/701,641

(22) Filed: Feb. 2, 2007

(65) Prior Publication Data

US 2007/0184253 A1 Aug. 9, 2007

(30) Foreign Application Priority Data

Feb. 9, 2006 (JP) ..... 2006-032481

(51) Int. Cl.

| | |
|---|---|
| ***B32B 7/02*** | (2006.01) |
| ***B32B 15/04*** | (2006.01) |
| ***B32B 19/00*** | (2006.01) |
| ***B32B 9/00*** | (2006.01) |

(52) U.S. Cl. ..... 428/704; 428/688; 428/689; 428/697; 428/698; 428/699; 428/472; 428/212

(58) Field of Classification Search ..... None
See application file for complete search history.

(56) References Cited

U.S. PATENT DOCUMENTS

| | | | |
|---|---|---|---|
| 4,872,904 | A | 10/1989 | Dorfman |
| 2004/0194662 | A1 | 10/2004 | Itsukaichi et al. |

FOREIGN PATENT DOCUMENTS

| | | | |
|---|---|---|---|
| CN | 1047113 | A | 11/1990 |
| CN | 1978705 | A | 6/2007 |
| JP | 08-104969 | | 4/1996 |
| JP | 09-227243 | | 9/1997 |
| JP | 09227243 | * | 9/1997 |
| JP | 09-268361 | | 10/1997 |
| JP | 2004-277828 | | 10/2004 |
| JP | 2004-300555 | | 10/2004 |
| JP | 2006336091 | * | 12/2006 |

OTHER PUBLICATIONS

H. Lille, Proc. Estonian Acad. Sci. Eng. 2002, 8, 3, 162-173.*

* cited by examiner

*Primary Examiner*—Jennifer C McNeil
*Assistant Examiner*—Vera Katz
(74) *Attorney, Agent, or Firm*—Vidas, Arrett & Steinkraus, P.A.

(57) ABSTRACT

A thermal spray coating is made of cermet and provided on the surface of a base. The value that is gained by further dividing the value, which is gained by dividing the coefficient of thermal expansion of the thermal spray coating by the thickness of the thermal spray coating (unit: μm), by the coefficient of thermal expansion of the base is set to a value no less than $0.15\times10^{-2}$. Accordingly, peeling and cracking of the thermal spray coating can be prevented from being caused by the difference in the coefficient of thermal expansion between the thermal spray coating and the base.

5 Claims, 1 Drawing Sheet

THERMAL SPRAY COATING AND THERMAL SPRAY POWDER

BACKGROUND OF THE INVENTION

The present invention relates to a thermal spray coating made of cermet, and a thermal spray powder used to gain such a thermal spray coating.

It is known according to the prior art to provide a thermal spray coating made of cermet on the surface of the cavity of a die casting mold and on the surface of a roll in a hot dip plating bath in order to prevent damage caused by melted metal. Japanese Laid-Open Patent Publication No. 2004-300555 discloses a thermal spray material which is useful for such an application.

In the case where a thermal spray coating made of cermet is provided on the surface of a base member made of a metal, the coefficient of thermal expansion of the thermal spray coating is smaller than the coefficient of thermal expansion of the base member. Therefore, the thermal spray coating may peel or crack. As a result, there is a risk that the base member cannot be sufficiently prevented from being damaged.

Japanese Laid-Open Patent Publication No. 2004-277828 discloses the provision of an intermediate layer, exhibiting a coefficient of thermal expansion between those of the thermal spray coating and the base member, between the thermal spray coating and the base member as a means for preventing peeling and cracking of the thermal spray coating. In this case, however, another problem may arise such that cost increases due to an increase in the number of steps of providing an intermediate layer.

SUMMARY OF THE INVENTION

An object of the present invention is to make it possible to prevent peeling and cracking of the thermal spray coating due to the difference in the coefficient of thermal expansion between the thermal spray coating and the base member without providing an intermediate layer between the thermal spray coating and the base member.

In order to achieve the above described object, one aspect of the present invention provides a thermal spray coating made of cermet on the surface of a base member, wherein a value gained by dividing, by the coefficient of thermal expansion of the base member, a value that is gained by dividing the coefficient of thermal expansion of the thermal spray coating by the thickness of the thermal spray coating (unit: μm) is no less than $0.15\times10^{-2}$.

Another aspect of the present invention also provides a thermal spray powder which is used to gain a thermal spray coating as described above, and includes cermet containing boron, molybdenum, chromium, and cobalt, or cermet containing carbon, tungsten, and cobalt.

DETAILED DESCRIPTION OF THE PREFERRED EMBODIMENTS

In the following, a preferred embodiment of the present invention will be described.

Figure 1:
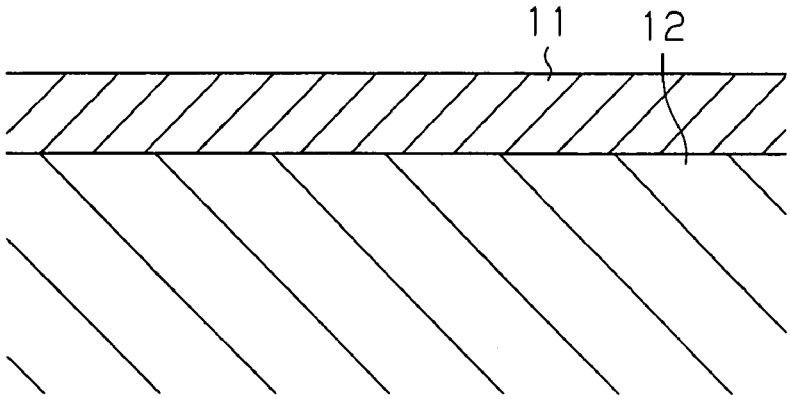
FIG. 1 is a cross-sectional view showing a thermal spray coating provided on the surface of a base according to one embodiment of the present invention.

As shown in FIG. 1, a thermal spray coating 11 according to the present embodiment is provided on the surface of a base 12, which is a base member. The thermal spray coating 11 makes contact with the surface of the base 12.

The thermal spray coating 11 includes cermet, such as that containing boron, molybdenum, chromium, and cobalt, or such as that containing carbon, tungsten, and cobalt. It is preferable that the thermal spray coating 11 include cermet containing boron, molybdenum, chromium, and cobalt in order to gain a thermal spray coating 11 having a high resistance to damage caused by a melted metal.

Though the material of the base 12 is not particularly limited, it is usually a metal, and the coefficient of thermal expansion of the base 12 is greater than the coefficient of thermal expansion of the thermal spray coating 11.

In order to prevent peeling and cracking of the thermal spray coating 11 caused by the difference in the coefficient of thermal expansion between the thermal spray coating 11 and the base 12, it is essential that the value of Cd which is gained by dividing, by the coefficient of thermal expansion ($\alpha2$) of the base 12, a value that is gained by dividing the coefficient of thermal expansion ($\alpha1$) of the thermal spray coating 11 by the thickness (t) of the thermal spray coating 11 (unit: μm) be no less than $0.15\times10^{-2}$. That is to say, it is essential that the formula: $Cd=\alpha1/t/\alpha2\geqq0.15\times10^{-2}$ be satisfied. Here, in the case where the value of Cd is less than $0.2\times10^{-2}$, and more specifically less than $0.25\times10^{-2}$, peeling and cracking of the thermal spray coating 11 are not sufficiently prevented even when the value of Cd is no less than $0.15\times10^{-2}$. Accordingly, it is preferable that the value of Cd be no less than $0.2\times10^{-2}$, and more preferably no less than $0.25\times10^{-2}$ in order to sufficiently prevent peeling and cracking of the thermal spray coating 11.

It can be seen from the above described formula that the smaller the thickness (t) of the thermal spray coating 11 is, the greater the value of Cd is. Therefore, it is preferable that the thickness of the thermal spray coating 11 be as small as possible in order to prevent peeling and cracking of the thermal spray coating 11. Here, as the thickness of the thermal spray coating 11 becomes smaller, the possibility of through holes existing in the thermal spray coating 11 becomes higher. When through holes exist in the thermal spray coating 11, a melted metal reaches the base 12 through the through holes, and therefore, damage to the base 12 from the melted metal cannot be prevented in the case of exposure to the melted metal. In order to reduce the number of through holes which exist in the thermal spray coating 11, it is preferable that the formula: $t-23e^{0.3P}\geqq0$ (where, $0<P\leqq10$) be satisfied when the porosity of the thermal spray coating 11 is defined as P (unit: %) and the thickness of the thermal spray coating 11 is defined as t (unit: μm). Furthermore, it is preferable that the porosity of the thermal spray coating 11 be no higher than 7%, and more preferably no higher than 4%. In other words, it is preferable, with the presupposition that the formula: $t-23e^{0.3P}\geqq0$ is satisfied, that the porosity of the thermal spray coating 11 be no higher than 10%, more preferably no higher than 7%, and most preferably no higher than 4%.

The thermal spray coating 11 is formed by spraying the cermet powder onto the surface of the base 12. Concretely, the thermal spray coating 11 made of cermet containing boron, molybdenum, chromium, and cobalt is gained by spraying, for example, an MoB/CoCr cermet powder, which is a composite of molybdenum boride and a cobalt chromium alloy. In addition, the thermal spray coating 11 made of cermet containing carbon, tungsten, and cobalt is gained by spraying, for example, a WC/Co cermet powder, which is a composite of tungsten carbide and cobalt.

The MoB/CoCr cermet powder is gained by, for example, fabricating a granulated powder from a mixture of a molybdenum boride powder and a cobalt chromium alloy powder, sintering and breaking this granulated powder into smaller particles, and furthermore, classifying the granulated powder. Alternately, the MoB/CoCr cermet powder is gained by compressing and molding and then sintering a mixture of a molybdenum boride powder and a cobalt chromium alloy powder, and crushing and classifying the thus gained sintered body. The WC/Co cermet powder is gained by fabricating a granulated powder from, for example, a mixture of a tungsten carbide powder and a cobalt powder, sintering and breaking this granulated powder into smaller particles, and furthermore, classifying the granulated powder. Alternately, the WC/Co cermet powder is gained by compressing and molding and then sintering a mixture of a tungsten carbide powder and a cobalt powder, and crushing and classifying the thus gained sintered body. Here, in the case of either cermet powder, it is preferable to manufacture the cermet powder in accordance with a granulation-sintering method where a granulated powder is fabricated from a material powder, and the step of sintering this granulated powder is undergone. This is because cermet powders which are manufactured in accordance with a granulation-sintering method generally have excellent flowability in comparison with cermet powders which are manufactured in accordance with other manufacturing methods, such as a sintering-crushing method where a material powder is compressed and molded and then sintered, and the step of crushing the gained sintered body is undergone. In addition, in the case of the granulation-sintering method, the step of crushing is not included in the manufacturing process, and therefore, there is no risk that an impurity is mixed in during crushing.

It is preferable that the average particle size of the cermet powder be 5 μm to 50 μm. In the case where the average particle size of the cermet powder is less than 5 μm, a phenomenon which is called spitting, where a melted cermet powder adheres to the tip of the nozzle of the spraying machine at the time of spraying, is frequently observed. Meanwhile, in the case where the average particle size of the cermet powder exceeds 50 μm, the porosity of the thermal spray coating 11 tends to be high, and the risk of through holes existing in the thermal spray coating 11 is high. The average particle size of the cermet powder is measured using, for example, a laser diffraction/scattering type particle size measuring machine "LA-300", manufactured by Horiba Ltd.

The method for spraying a cermet powder in order to form a thermal spray coating 11 may be any of plasma spraying, flame spraying, and high velocity flame spraying (high velocity oxy-fuel spraying: HVOF spraying), or may be other spraying methods. Here, high velocity flame spraying is preferable in order to gain a thermal spray coating 11 with high density.

The following advantages are gained according to the present embodiment.

According to the present embodiment, the value of Cd which is gained by further dividing, by the coefficient of thermal expansion of the base 12, a value that is gained by dividing the coefficient of thermal expansion of the thermal spray coating 11 by the thickness of the thermal spray coating 11 (unit: μm) is set at a value no less than $0.15\times10^{-2}$, and therefore, peeling and cracking of the thermal spray coating 11 can be prevented from being caused by the difference in the coefficient of thermal expansion between the thermal spray coating 11 and the base 12. Accordingly, damage to the base 12 from a melted metal can be sufficiently prevented by the thermal spray coating 11 when exposed to the melted metal.

In the case where the porosity and the thickness of the thermal spray coating 11 are set so that the formula: $t-23e^{0.3P}\geqq0$ (where, $0<P\leqq10$) is satisfied, the number of through holes which exist in the thermal spray coating 11 is reduced, and therefore, damage to the base 12 from a melted metal can be more sufficiently prevented by the thermal spray coating 11.

The thermal spray coating 11 according to the present embodiment is made of cermet instead of ceramic. Thermal spray coatings made of cermet are generally high in their tenacity and resistance to thermal shock, and have small number of pores in the thermal spray coating in comparison with thermal spray coatings made of ceramic. These characteristics are advantageous for the thermal spray coating 11 which is provided on the surface of a base 12 for the sake of preventing damage to the base 12 from a melted metal.

In the case where the thermal spray coating 11 is made of cermet containing boron, molybdenum, chromium, and cobalt, resistance of the thermal spray coating 11 to damage caused by a melted metal increases. Accordingly, the thermal spray coating 11 made of cermet containing boron, molybdenum, chromium, and cobalt is particularly appropriate for the application where the thermal spray coating 11 is exposed to a melted metal.

The above described embodiment may be modified as follows.

The thermal spray coating 11 may be provided on the surface of a base 12, of which the quality of the surface has been improved through a nitriding treatment or a carbonizing treatment. In this case, the value of Cd which is gained by dividing, by the coefficient of thermal expansion ($\alpha2$) of the base 12, a value that is gained by dividing the coefficient of thermal expansion ($\alpha1$) of the thermal spray coating 11 by the thickness (t) of the thermal spray coating 11 (unit: μm) is set at a value of no less than $0.15\times10^{-2}$, preferably, no less than $0.2\times10^{-2}$, and more preferably, no less than $0.25\times10^{-2}$.

Figure 2:
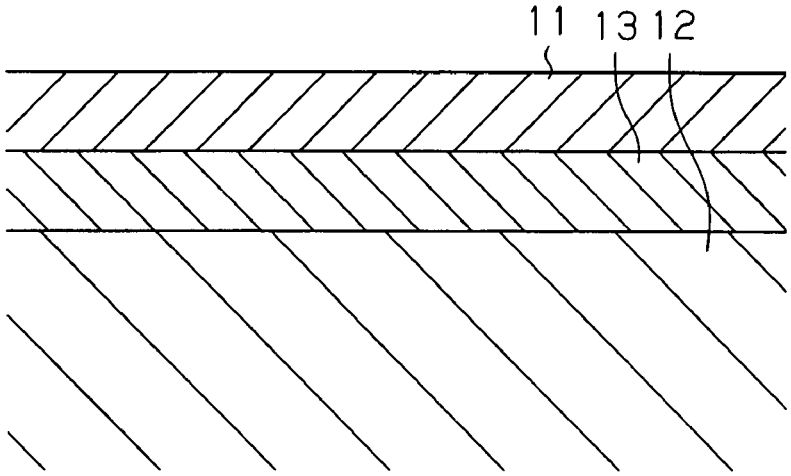
FIG. 2 is a cross-sectional view showing a thermal spray coating provided over a base according to another embodiment of the present invention.

As shown in FIG. 2, an intermediate layer 13 may be provided between the thermal spray coating 11 and the base 12 as an undercoating layer. In this case, the base member is not the base 12 but the intermediate layer 13, and the value of Cd which is gained by dividing, by the coefficient of thermal expansion ($\alpha2$) of the intermediate layer 13, a value that is gained by dividing the coefficient of thermal expansion ($\alpha1$) of the thermal spray coating 11 by the thickness (t) of the thermal spray coating 11 (unit: μm) is set at a value of no less than $0.15\times10^{-2}$, preferably, no less than $0.2\times10^{-2}$, and more preferably, no less than $0.25\times10^{-2}$. It is preferable that the coefficient of thermal expansion of the intermediate layer 13 be between those of the thermal spray coating 11 and the base 12. Though the thickness of the intermediate layer 13 is not particularly limited, it is preferable that the thickness be 20 μm to 800 μm. The intermediate layer 13 may be a thermal spray coating which is formed by spraying cermet, a metal or a mixture of cermet and a metal, or may be a non-thermal spray coating, such as a plated coating.

Next, the present invention is described in further detail by citing examples and comparative examples.

A thermal spray coating was formed on the surface of a base by spraying an MoB/CoCr cermet powder in Examples 1 to 7 and 10 to 14 as well as Comparative Examples 1 and 4. Here, as for the conditions for spraying, conditions for spraying A in Table 1 were used for Examples 1 to 3, 10 and 12 as well as Comparative Example 1; conditions for spraying B in Table 1 were used for Examples 4 to 7 and 14; and conditions for spraying C in Table 1 were used for Examples 11 and 13 as well as Comparative Example 4.

A thermal spray coating was formed on the surface of an intermediate layer provided on a base by spraying an MoB/CoCr cermet powder under the conditions for spraying A in Table 1 in Examples 8 and 9. Here, the intermediate layer is a thermal spray coating formed under the conditions for spraying C in Table 1.

A thermal spray coating was formed on the surface of a base by spraying a WC/Co cermet powder under the conditions for spraying A in Table 1 in Examples 15 and 16 as well as Comparative Examples 2, 3, 5 and 6.

A thermal spray coating was formed on the surface of a base by spraying an alumina ($Al_2O_3$) powder under the conditions for spraying D in Table 1 in Comparative Example 7.

A thermal spray coating was formed on the surface of a base by spraying a partially stabilized zirconia powder made of 92% by mol of zirconia and 8% by mol of yttria under the conditions for spraying D in Table 1 in Comparative Example 8.

Thermal spray coatings, bases and intermediate layers in Examples 1 to 16 as well as Comparative Examples 1 to 8 are shown in detail in Table 2.

The column "thickness of thermal spray coating" in Table 2 shows the results of the measurement of the thickness of the thermal spray coating in each example.

The column "coefficient of thermal expansion of thermal spray coating" in Table 2 shows the results of the measurement of the coefficient of thermal expansion of the thermal spray coating in each example in accordance with the following method. That is to say, the thermal spray coating having a thickness of 500 μm in each example is formed on the surface of a base (70 mm×50 mm×2.3 mm) made of an SS400 steel plate, on which a surface coarsening process using alumina grit #40 and an oil removing process had been carried out, and the coefficient of thermal expansion of the thermal spray coating was measured within a temperature range from 100° C. to 750° C. Concretely, a piece of the thermal spray coating having a dimension of 20 mm×3 mm, which was peeled from the base, was used to measure the coefficient of thermal expansion of the thermal spray coating using "TMA8310", made by Rigaku Corporation, while being heated from room temperature to 1000° C. at a heating rate of 20 K/min in an argon atmosphere.

The column "porosity of thermal spray coating" in Table 2 shows the results of the measurement of the porosity of the thermal spray coating in each example in accordance with the following method. That is to say, the thermal spray coating in each example was cut along the plane that was perpendicular to the upper surface of the thermal spray coating, and this cross sectional surface was polished to a mirror surface, and after that, the porosity of the thermal spray coating on the cross sectional surface was measured using an image analysis processing unit "NSFJ1-A", made by N Support Corp.

The column "material of base" in Table 2 shows the material of the base in each example. In this column, "SUS316L" and "SUS410" are respectively one type of stainless steel, and "SKD61" is one type of an alloy tool steel.

The column "coefficient of thermal expansion of base" in Table 2 shows the results of the measurement of the coefficient of thermal expansion of the base in each example using "TMA8310."

The column "material of intermediate layer" in Table 2 shows the material of the intermediate layer in each example. In this column, "Stellite #6" is an alloy of which the main component is cobalt, and "SUS440C" is one type of stainless steel.

The column "coefficient of thermal expansion of intermediate layer" in Table 2 shows the results of the measurement of the coefficient of thermal expansion of the intermediate layer in each example using "TMA8310."

The column "value of Cd" in Table 2 shows the value of Cd in each example, which was gained by dividing, by the coefficient of thermal expansion of the base member (base or intermediate layer), a value that was gained by dividing the coefficient of thermal expansion of the thermal spray coating by the thickness of the thermal spray coating (unit: μm).

The column "value of K" in Table 2 shows the value of K in each example, which was represented by the formula: $K=t-23e^{0.3P}$, when the porosity of the thermal spray coating was defined as P (unit: %) and the thickness of the thermal spray coating was defined as t (unit: μm).

The column "resistance to cracking" and the column "resistance to peeling" in Table 2 show the results of evaluating the resistance to cracking and the resistance to peeling of the thermal spray coating in each example in accordance with the following method. That is to say, a thermal spray coating was provided on a base in round rod form having a diameter of 19 mm×a height of 200 mm without an intermediate layer intervening in the case of Examples 1 to 7 and 10 to 16 as well as Comparative Examples 1 to 8, and with an intermediate layer intervening in the case of Examples 8 and 9, and thereby, samples were fabricated. These samples were heated to 750° C. for 2 hours in the atmosphere. After that, the samples were naturally cooled to room temperature and then cut, and the cross sectional surfaces were polished into mirror surfaces after being filled in with a resin. Then, these cross sectional surfaces were observed using an optical microscope with a magnifying ratio of 200, and the resistance to cracking and the resistance to peeling of the thermal spray coating in each example were evaluated on the basis of the results of these observations. Concretely, as for the resistance to cracking, the evaluation was poor (x) in the case where there was penetrating cracking which penetrated through the thermal spray coating on the cross sectional surface, acceptable (Δ) in the case where there was no penetrating cracking but no less than 2 non-penetrating crackings which did not penetrate through the thermal spray coating, good (○) in the case where there was no penetrating cracking but one non-penetrating cracking, and excellent (○○) in the case where there were neither types of cracking. As for the resistance to peeling, the evaluation was poor (x) in the case where there was a gap in the interface between the thermal spray coating and the base member on the cross sectional surface or there was peeling of the thermal spray coating, and good (○) in the case where there was no peeling of the thermal spray coating and there was also no gap in the interface between the thermal spray coating and the base member on the cross sectional surface.

The column "through holes" in Table 2 shows the results of evaluating the degree of through holes which existed in the thermal spray coating in each example through a salt spraying test. That is to say, the thermal spray coating in each example was provided on the surface of a base (70 mm×50 mm×2.3 mm) made of an SS400 steel plate, on which a surface coarsening process using alumina grit #40 and an oil removing process had been carried out, without providing an intermediate layer, and thereby, samples were fabricated, and these samples were subjected to a salt spraying test in accordance with JIS Z2371. The salt spraying test was carried out under the conditions where the temperature within the test tank (spraying chamber) was 35+/−1° C., the temperature of the air saturating container was 47+/−1° C., the amount of spraying was 1 mL/hr to 2 mL/hr and the pressure for spraying was 0.098+/−0.002 MPa. Then, the degree of through holes which existed in the thermal spray coating in each example was evaluated on the basis of the situation where rusting occurred after the salt spraying test. Concretely, the evaluation was poor (x) in the case where rusting was observed 24 hours after the spraying of salt, acceptable (Δ) in the case where no rusting was observed 24 hours after the spraying of salt, but rusting was observed 48 hours after the spraying of salt, good (○) in the case where no rusting was observed 48 hours after the spraying of salt, but rusting was observed 72 hours after the spraying of salt, and excellent (○○) in the case where no rusting was observed even 72 hours after the spraying of salt.

TABLE 1

| | |
|---|---|
| Conditions for spraying A | |
| Spraying machine: | High velocity flame spraying machine "JP-5000", made by Praxair/TAFA Inc. |
| Amount of oxygen flow: | 1900 scfh (893 L/min) |
| Amount of kerosene flow: | 5.1 gph (0.32 L/min) |
| Spraying distance: | 380 mm |
| Length of barrel of spraying machine: | 203.2 mm |
| Amount of supply of thermal spray powder: | 70 g/min |
| Conditions for spraying B | |
| Spraying machine: | High velocity flame spraying machine "JP-5000", made by Praxair/TAFA Inc. |
| Amount of oxygen flow: | 1900 scfh (893 L/min) |
| Amount of kerosene flow: | 5.1 gph (0.32 L/min) |
| Spraying distance: | 380 mm |
| Length of barrel of spraying machine: | 152.4 mm |
| Amount of supply of thermal spray powder: | 70 g/min |
| Conditions for spraying C | |
| Spraying machine: | High velocity flame spraying machine "JP-5000", made by Praxair/TAFA Inc. |
| Amount of oxygen flow: | 1900 scfh (893 L/min) |
| Amount of kerosene flow: | 5.1 gph (0.32 L/min) |
| Spraying distance: | 380 mm |
| Length of barrel of spraying machine: | 101.6 mm |
| Amount of supply of thermal spray powder: | 70 g/min |
| Conditions for spraying D | |
| Spraying machine: | Plasma spraying machine "SG-100", made by Praxair |
| Powder feeder: | "Model 1264", made by Praxair |
| Ar gas pressure: | 50 psi |
| He gas pressure: | 50 psi |
| Voltage: | 37.0 V |
| Current: | 900 A |
| Spraying distance: | 100 mm |
| Amount of supply of thermal spray powder: | 15 g per minute |

TABLE 2

| | Thickness of thermal spray coating (μm) | Coefficient of thermal expansion of thermal spray coating ($\times 10^{-6}$/K) | Porosity of thermal spray coating (%) | Base material | Coefficient of thermal expansion of base ($\times 10^{-6}$/K) | Intermediate layer material |
|---|---|---|---|---|---|---|
| Example 1 | 100 | 9.5 | 2.5 | SUS316L | 18.1 | — |
| Example 2 | 100 | 9.5 | 2.2 | SKD61 | 10.5 | — |
| Example 3 | 70 | 9.5 | 3.0 | SUS316L | 18.1 | — |
| Example 4 | 110 | 9.5 | 5.2 | SUS316L | 18.1 | — |
| Example 5 | 220 | 9.5 | 4.0 | SUS316L | 18.1 | — |
| Example 6 | 240 | 9.5 | 5.0 | SUS316L | 18.1 | — |
| Example 7 | 240 | 9.5 | 6.0 | SUS410 | 12.3 | — |
| Example 8 | 240 | 9.5 | 5.5 | SUS316L | 18.1 | Stellite#6 |
| Example 9 | 240 | 9.6 | 7.5 | SUS316L | 18.1 | SUS440C |
| Example 10 | 240 | 8.9 | 2.5 | SUS316L | 18.1 | — |
| Example 11 | 240 | 8.2 | 7.0 | SUS316L | 18.1 | — |
| Example 12 | 280 | 8.1 | 2.0 | SUS316L | 18.1 | — |
| Example 13 | 390 | 10.8 | 9.4 | SUS316L | 18.1 | — |
| Example 14 | 420 | 11.8 | 5.8 | SUS316L | 18.1 | — |
| Example 15 | 190 | 6.2 | 1.3 | SUS316L | 18.1 | — |
| Example 16 | 230 | 6.2 | 1.2 | SUS316L | 12.3 | — |
| Comparative Example 1 | 400 | 9.5 | 4.0 | SUS316L | 18.1 | — |
| Comparative Example 2 | 250 | 6.2 | 2.0 | SUS316L | 18.1 | — |
| Comparative Example 3 | 360 | 6.2 | 1.4 | SUS410 | 12.1 | — |
| Comparative Example 4 | 420 | 9.5 | 11.0 | SUS316L | 18.1 | — |
| Comparative Example 5 | 250 | 6.2 | 2.6 | SUS316L | 18.1 | — |
| Comparative Example 6 | 360 | 6.2 | 2.0 | SUS410 | 12.1 | — |
| Comparative Example 7 | 320 | 8.1 | 7.1 | SUS316L | 18.1 | — |
| Comparative Example 8 | 200 | 10.4 | 8.5 | SUS316L | 18.1 | — |

TABLE 2-continued

| | Coefficient of thermal expansion of of intermediate layer ($\times 10^{-6}$/K) | Value of Cd | Value of K | Resistance to cracking | Resistance to peeling | Through holes |
|---|---|---|---|---|---|---|
| Example 1 | — | 0.52 | 51 | ○○ | ○ | ○○ |
| Example 2 | — | 0.90 | 55 | ○○ | ○ | ○○ |
| Example 3 | — | 0.75 | 13 | ○○ | ○ | ○○ |
| Example 4 | — | 0.48 | 1 | ○○ | ○ | ○ |
| Example 5 | — | 0.24 | 144 | ○ | ○ | ○○ |
| Example 6 | — | 0.22 | 137 | ○ | ○ | ○ |
| Example 7 | — | 0.32 | 101 | ○○ | ○ | ○ |
| Example 8 | 15.2 | 0.26 | 183 | ○○ | ○ | ○ |
| Example 9 | 12.1 | 0.33 | 178 | ○○ | ○ | Δ |
| Example 10 | — | 0.20 | 191 | ○ | ○ | ○○ |
| Example 11 | — | 0.19 | 52 | Δ | ○ | ○ |
| Example 12 | — | 0.16 | 238 | Δ | ○ | ○○ |
| Example 13 | — | 0.15 | 4 | Δ | ○ | Δ |
| Example 14 | — | 0.16 | 289 | Δ | ○ | ○ |
| Example 15 | — | 0.18 | 156 | Δ | ○ | ○○ |
| Example 16 | — | 0.22 | 197 | ○ | ○ | ○○ |
| Comparative Example 1 | — | 0.13 | 343 | x | x | ○○ |
| Comparative Example 2 | — | 0.14 | 208 | x | x | ○○ |
| Comparative Example 3 | — | 0.14 | 325 | x | x | ○○ |
| Comparative Example 4 | — | 0.12 | −204 | x | x | x |
| Comparative Example 5 | — | 0.14 | 200 | x | x | ○○ |
| Comparative Example 6 | — | 0.14 | 318 | x | x | ○○ |
| Comparative Example 7 | — | 0.14 | 126 | x | x | Δ |
| Comparative Example 8 | — | 0.29 | −95 | ○○ | x | x |

As shown in Table 2, results which are satisfactory for practical use were gained in terms of resistance to cracking and resistance to peeling in Examples 1 to 16, while results which are satisfactory for practical use were not gained, at least in terms of resistance to peeling, from among resistance to cracking and resistance to peeling in Comparative Examples 1 to 8. In addition, the evaluation concerning through holes was no worse than acceptable in all of Examples 1 to 16.

The invention claimed is:

1. A thermal spray coating made of cermet containing boron, molybdenum, chromium, and cobalt on a surface of a base member, wherein a value gained by dividing, by a coefficient of thermal expansion of the base member, a value that is gained by dividing a coefficient of thermal expansion of the thermal spray coating by a thickness of the thermal spray coating (unit: μm) is no less than $0.15\times10^{-2}$, wherein a formula: $t-23e^{0.3P}\geqq 0$ (where, $0<P\leqq 4$) is satisfied when a porosity of the thermal spray coating is defined as P (unit: %) and the thickness of the thermal spray coating is defined as t (unit: μm), and the average particle size of the cermet is between 5 to 50 μm.

2. The thermal spray coating according to claim 1, wherein said base member is an undercoating layer provided on a base.

3. The thermal spray coating according to claim 2, wherein a coefficient of thermal expansion of the undercoating layer is between those of the thermal spray coating and the base.

4. The thermal spray coating according to claim 1, wherein said base member is a metal base.

5. The thermal spray coating according to claim 1, wherein the thermal spray coating is formed by high velocity flame spraying.

* * * * *